US007938108B2

(12) United States Patent
Popov et al.

(10) Patent No.: US 7,938,108 B2
(45) Date of Patent: May 10, 2011

(54) REVERSE CROSSBOW

(76) Inventors: Sergey Olegovich Popov, Moscow (RU); Pavel Vitalievich Ivanov, Moscow (RU); Sergey Anatolievich Golovatyy, Moscow (RU)

( * ) Notice: Subject to any disclaimer, the term of this patent is extended or adjusted under 35 U.S.C. 154(b) by 748 days.

(21) Appl. No.: 11/916,289

(22) PCT Filed: May 3, 2007

(86) PCT No.: PCT/RU2007/000218

§ 371 (c)(1),
(2), (4) Date: Dec. 2, 2007

(87) PCT Pub. No.: WO2008/130264

PCT Pub. Date: Oct. 30, 2008

(65) Prior Publication Data

US 2010/0116259 A1 May 13, 2010

(30) Foreign Application Priority Data

Apr. 20, 2007 (RU) ..... 2007114803

(51) Int. Cl.
*F41B 5/12* (2006.01)

(52) U.S. Cl. ..... 124/25; 124/25.6

(58) Field of Classification Search ..... 124/25, 124/25.6

See application file for complete search history.

(56) References Cited

U.S. PATENT DOCUMENTS 3,108,583 A * 10/1963 Andis ..... 124/22
3,224,427 A * 12/1965 Ronan ..... 124/25
3,515,113 A * 6/1970 Lawrence ..... 124/27
4,169,456 A * 10/1979 Van House ..... 124/61
4,722,317 A * 2/1988 Hartwig ..... 124/25.6
4,766,874 A * 8/1988 Nishioka ..... 124/25
4,879,987 A * 11/1989 Nishioka ..... 124/25
4,917,071 A * 4/1990 Bozek ..... 124/25
4,976,250 A * 12/1990 Jeffrey ..... 124/25
5,553,596 A * 9/1996 Bednar ..... 124/25
5,630,405 A * 5/1997 Nizov ..... 124/25
6,267,108 B1 * 7/2001 McPherson et al. ..... 124/25
6,705,304 B1 * 3/2004 Pauluhn ..... 124/25
6,874,491 B2 * 4/2005 Bednar ..... 124/25
7,100,590 B2 * 9/2006 Chang ..... 124/25
7,178,514 B2 * 2/2007 Chang ..... 124/25
7,188,615 B2 * 3/2007 Chang ..... 124/25.6
7,281,534 B2 * 10/2007 Bednar ..... 124/25
7,328,693 B2 * 2/2008 Kempf ..... 124/25
7,363,921 B2 * 4/2008 Kempf ..... 124/25
7,455,059 B2 * 11/2008 Shaffer ..... 124/25
7,578,289 B2 * 8/2009 Norkus ..... 124/25.6
7,624,724 B2 * 12/2009 Bednar et al. ..... 124/25
7,661,418 B2 * 2/2010 Bednar et al. ..... 124/25
7,743,760 B2 * 6/2010 Woodland ..... 124/25.6
2002/0020403 A1 * 2/2002 Troubridge ..... 124/89
2005/0279338 A1 * 12/2005 Dziekan ..... 124/25
2006/0054150 A1 * 3/2006 Kempf ..... 124/25
2006/0144380 A1 * 7/2006 Kempf ..... 124/25
2006/0169258 A1 * 8/2006 Chang ..... 124/25
2006/0169259 A1 * 8/2006 Chang ..... 124/25

(Continued)

*Primary Examiner* — Gene Kim
*Assistant Examiner* — Alexander R Niconovich
(74) *Attorney, Agent, or Firm* — patenttm.us

(57) ABSTRACT

This invention relates to sporting and hunting throwing weaponry, more specifically, crossbow. The crossbow comprises a limbs riser, limbs oriented towards the shot direction, cams installed on the ends of said limbs, bowstring and cables passing through said cams and a barrel on which said limbs riser, a trigger mechanism and a foregrip are installed.

1 Claim, 7 Drawing Sheets

U.S. PATENT DOCUMENTS

2007/0028907 A1* 2/2007 Bednar et al. ..... 124/25
2007/0068501 A1* 3/2007 Bednar ..... 124/25
2007/0101979 A1* 5/2007 Bednar et al. ..... 124/25
2007/0261687 A1* 11/2007 Bednar ..... 124/25
2008/0168969 A1* 7/2008 Kempf ..... 124/25
2010/0000503 A1* 1/2010 Bednar et al. ..... 124/25
2010/0012108 A1* 1/2010 Bednar et al. ..... 124/25
2010/0132684 A1* 6/2010 Popov et al. ..... 124/86
2010/0170487 A1* 7/2010 Kronengold et al. ..... 124/25
2010/0170488 A1* 7/2010 Rasor et al. ..... 124/25
2010/0170489 A1* 7/2010 Shepley et al. ..... 124/25

* cited by examiner

REVERSE CROSSBOW

The invention relates sports and hunting throwing weapon, and more particularly to the weapon using the energy of a strained solid body; it may be used for designing and engineering the weapon for throwing projectiles, namely, a crossbow.

There is a known (U.S. Pat. No. 4,879,987) reverse crossbow containing a barrel, a trigger mechanism, a limbs riser, the limbs directed in the shooting direction having cams fixed to their ends, a hinged wheels device fixed to the barrel, a bowstring passing through cams and hinged wheels device.

One drawback associated with the known crossbow is the complex system of threading the bowstring and hinged wheels device that transfers vibrations arising in process of shooting to the barrel, as well as an inefficient arrangement of limbs on the limbs riser and the design of fastening of the limbs riser to the barrel. Besides the known design of a crossbow is nonseparable, thus it is impossible to remove the assembled bow from the barrel.

There is a known (RU patent 2093771/U.S. Pat. No. 5,630,405) reverse crossbow containing a limbs riser; the limbs directed in the shooting direction; the cams located on the ends of limbs; the bowstring and cables passing through cams; the barrel carrying a limbs riser and a trigger mechanism. Besides the known crossbow contains a carriage located on the bowstring, a carriage guide, an arrow guide. Thus the barrel is made with a groove and with a horizontal slot located in its forward part, the carriage is made with the longitudinal groove located in its bottom part, a channel under a bowstring and cut-outs located on its front surface, where the number of cut-outs corresponds to the number of arrow head fletchings.

It is necessary to recognize as a drawback of the known crossbow, the location of the limbs riser, the geometry of limbs arrangement, the layout of bowstring, that in turn leads to reducing the power stroke, to inefficient use of energy accumulated by limbs after cocking the crossbow, large dimensions of the crossbow, limited opportunities for balancing the crossbow, caused by constructive imperfection of separate units, as well as the all crossbow design as a whole.

The object of this invention is to create an advanced design of a crossbow allowing to increase the overall performance of limbs, to simplify the process of assembly and disassembly of a crossbow for transportation and storage, to reduce overall dimensions of the crossbow, to improve balancing and ergonomical characteristic of a crossbow, to lower the noise level and kickback when shooting, to reduce vibrations arising when shooting.

The technical result achieved by realization of this invention, consists in improving the maximal initial speed of the thrown projectile, improving the accuracy and grouping of shooting, reducing the overall dimensions of a crossbow, decreasing the kickback, noise and vibrations when shooting, simplifying the process of assembly and disassembly of a crossbow, making the replacement of bowstring and cables easier, improving the balancing and ergonomic properties of a crossbow.

For achieving the above technical result the author proposes to use a crossbow containing a limbs riser, the limbs directed in the direction of shooting, the cams located on the ends of limbs, the bowstring and cables passing through cams, a barrel carrying a limbs riser and a trigger mechanism. Here the limbs riser is located at the edge of the barrel behind the trigger mechanism and centered relative to the barrel using a cone on the bottom surface of the limbs riser and reciprocal conical recess in the barrel, where the limbs riser is fixed using a single threaded junction that allows to improve balancing of a crossbow and to simplify the process of assembling and disassembling the crossbow to the maximum. The initial angle of installation of limbs on their riser and the point of their fastening are chosen so that when raising the crossbow the axis of rotation of each cam crosses the line parallel to the central axis of the crossbow and passing through the point of the beginning of bend of each of the limbs, thus the distance between axes of rotation of the cams of the cocked crossbow is less than the distance between the points of the beginning of the bend of limbs, that together with the chosen initial position of cams allows to realize the most efficient operation of the limbs, to reduce the dimensions of crossbow, to reduce the noise level and the kickback. The tension bars of cables are designed in such a manner that they allow to use a compact detachable device for mounting and removing the bowstring and cables. The shape and the angle of inclination of the crossbow foregrip allows the shooter to choose the most convenient position for holding the crossbow and for shooting.

Further the design will be disclosed with the use of a graphic material, where:

The main units of this design of reverse crossbow are further described in detail.

Figure 1:
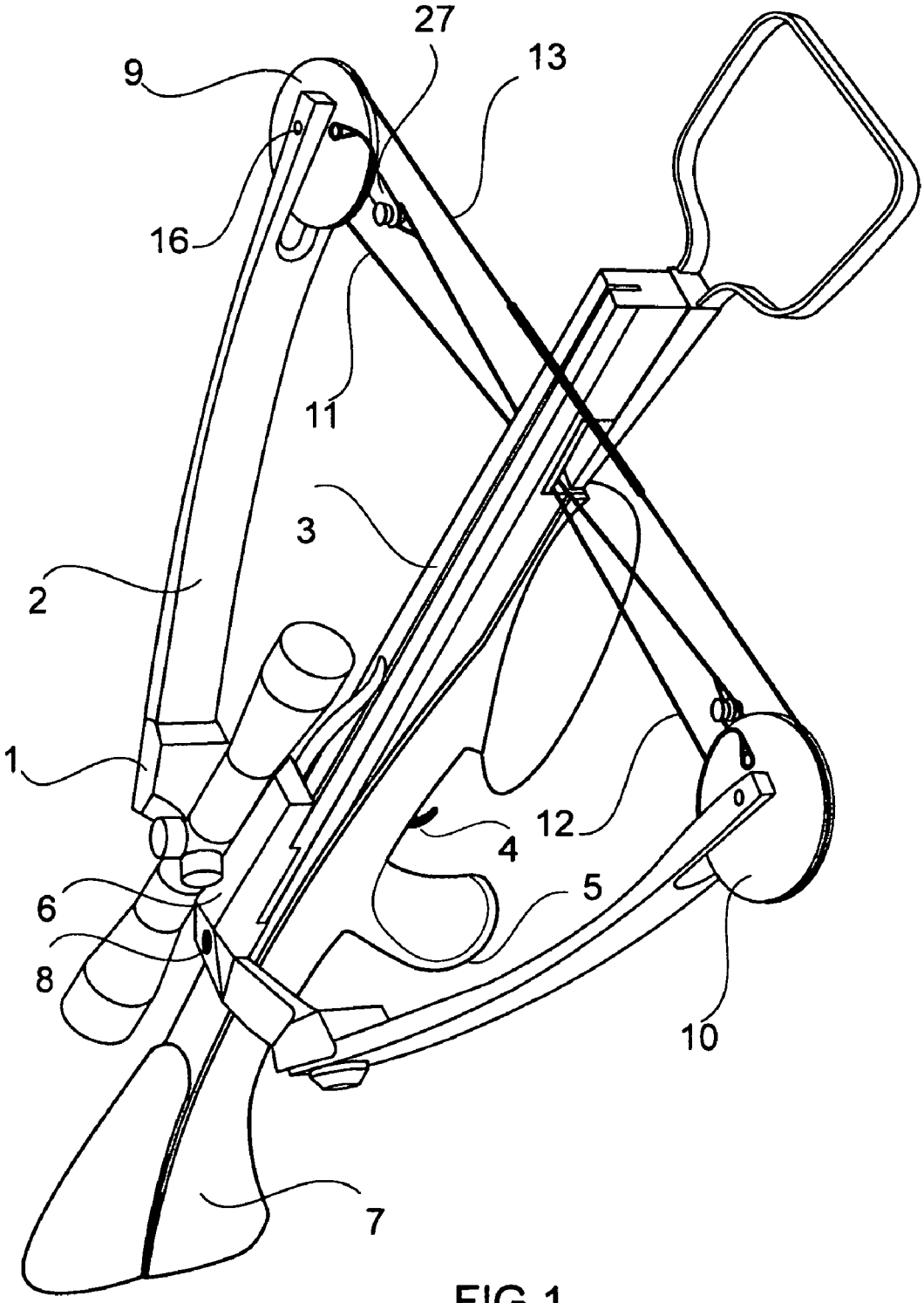
FIG. 1 illustrates the general view of the developed design of a crossbow.

The limbs riser 1 of FIG. 1 wherein it is located on the edge of the barrel 3, behind the trigger mechanism 4, behind the handle 5, behind the unit for fastening a sight 6, thus allowing to shift the weight of limbs riser 1 closer to the shooter, to the butt 7. This allows to reach the best balancing of the crossbow as a whole and makes handling the crossbow and aiming easier and more convenient thus improving the accuracy and grouping of shooting.

Such an arrangement of limbs riser 1 allows as against the known designs (U.S. Pat. No. 4,879,987; U.S. Pat. No. 5,630,405) to extend the limbs 2 without extending the overall dimensions of the crossbow thus extending the resource, the service life of limbs 2 and the stability of their operation due to distribution of bending load over a much greater area of a loose part of limbs during their operation.

Figure 2:
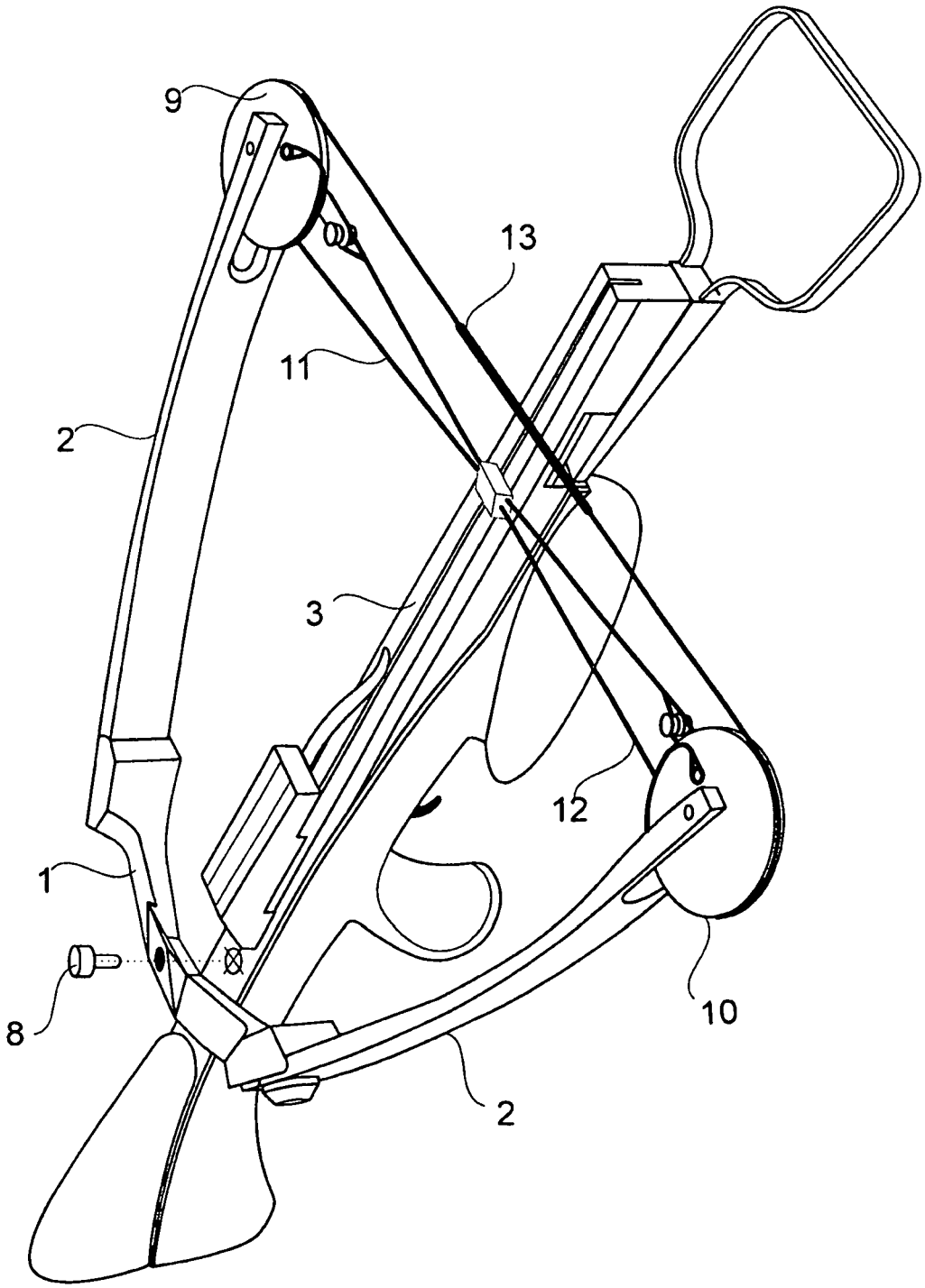
FIG. 2 illustrates the installation diagram of limbs assembled with the limbs riser on the barrel.

The limbs riser 1, in combination with limbs 2, cams 9, 10 and fixed bowstring 13, cables 11, 12, is attached by a single screw 8 to the top of the barrel 3 thus providing a convenient and fast assembly and disassembly of the crossbow for transportation and storage (FIG. 2).

Figure 3:
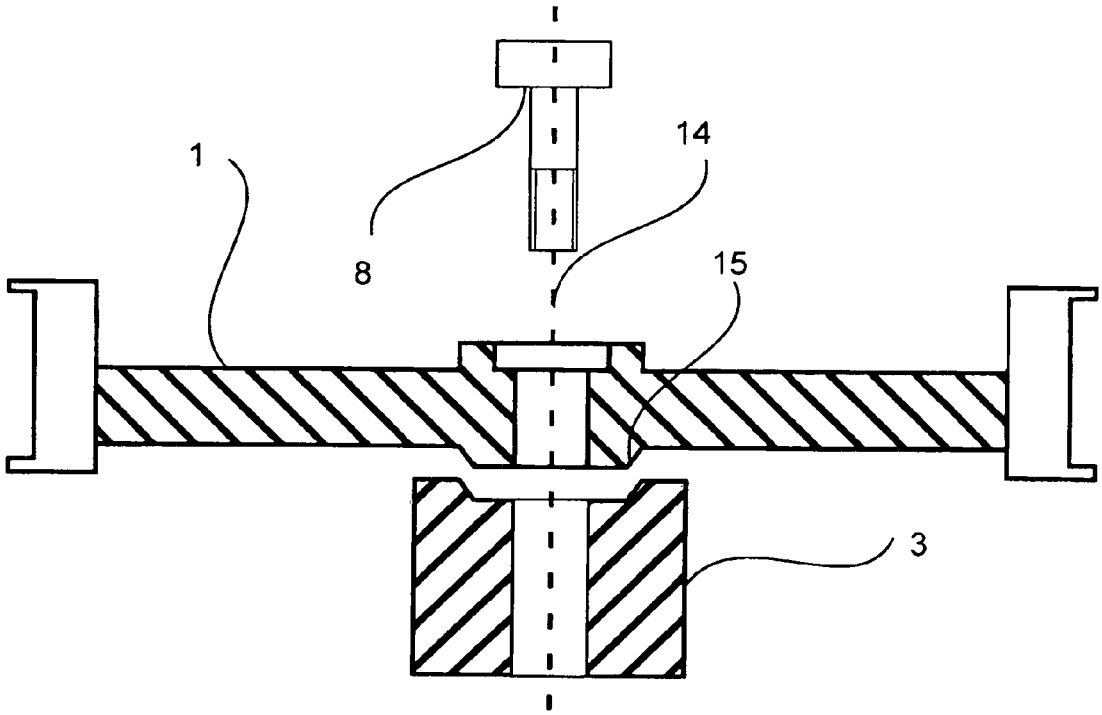
FIG. 3 illustrates the method of fixing the limbs riser on the barrel.

When mounting the limbs riser 1 of FIG. 3 to the barrel 3 the limbs riser 1 is being centered about the vertical plane 14 passing through the central axis of the crossbow. The centering occurs due to presence of a cone 15 on the limbs riser 1 and of reciprocal conical recess on the barrel 3. The well-defined seating of the limbs riser 1 having no bias on the barrel is very important for accurate shooting. This decision also reduces the dimensions of limbs riser 1 and the number of fixing parts, thus also reducing the production cost.

Figure 4:
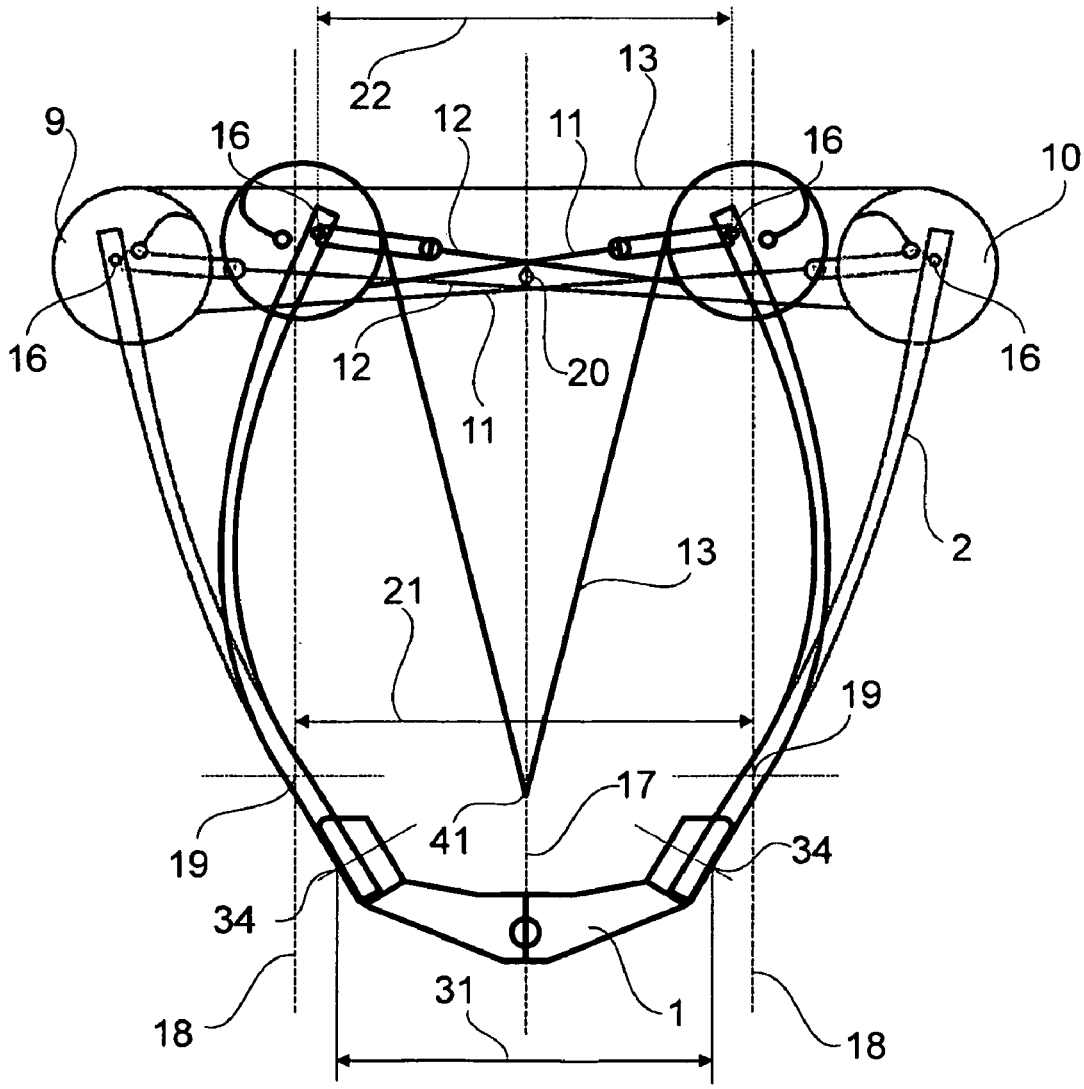
FIG. 4 illustrates the geometrical features of positioning the limbs on the riser.

In this design of a reverse crossbow (FIG. 4) the initial angle of installation of limbs 2 on the limbs riser 1, the design of limbs 2 and the distance 31 between the points of fastening 34 are chosen in such a manner that when cocking the crossbow, the axis of rotation of 16 cams 9, 10 cross the lines 18 parallel to the central axis of the crossbow 17 passing through the points 19 of beginning of bend of limbs 2. Thus the distance 22 between the axes of rotation of blocks 16, when the limbs 2 are cocked, is less than the distance 21 between the points 19 of beginning of bend of limbs 2. This decision has allowed to reduce the dimensions of the design as a whole, and to reduce the component of the moment of inertia arising during the movement of limbs 2 when shooting that has in turn allowed to decrease considerably the kickback moment and the noise level when shooting.

The above layout of limbs 2, has allowed to reduce considerably the range of movement 20 of cables 11, 12 along the axis of crossbow 17 thus reducing the vibration and loss due to friction arising in connection with longitudinal movement of cables when shooting.

Figure 5:
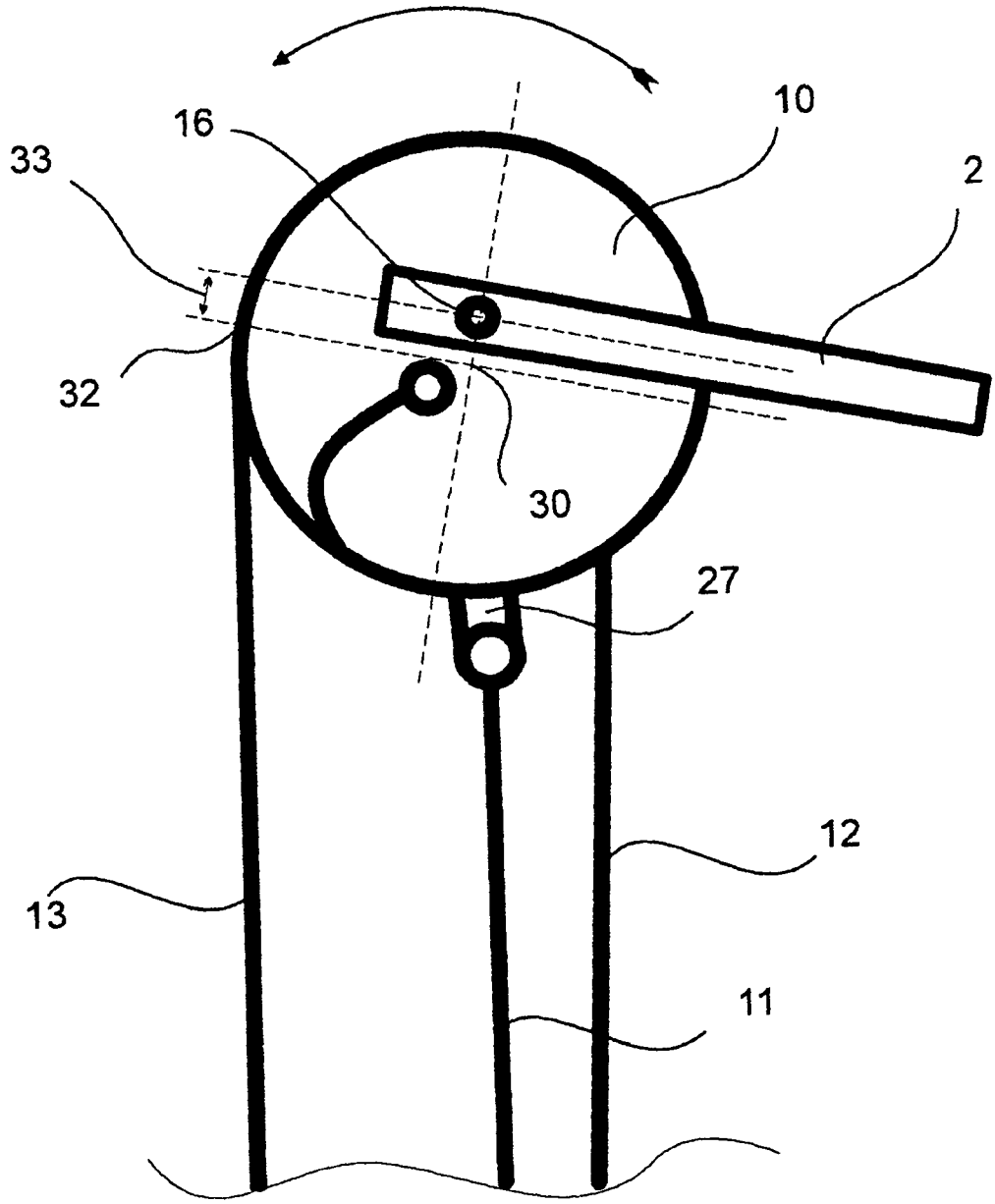
FIG. 5 illustrates the initial position of a cam.

In this design for increasing the initial velocity of a the thrown projectile, there is a fixed initial position of the cam 10 (FIG. 5) (the position of cam 9 is a mirror reflection of the cam 10) set by the position of the axis of rotation of cam 16 that is located on the perpendicular from the geometrical center of cam 30 to the axis of rotation of cam 16. Thus the geometrical center 30 is located inside the area limited by limbs 2. The distance 33 from the geometrical center 30 to the axis 16 of rotations of the cam depends on the chosen value of eccentricity. The range of positions of initial position of the cam 10 (the crossbow is not cocked), is limited to a position of cam 10 when the distance 33 between the plane passing through the geometrical center of cam 30 and the point 32 of crossing with the operational bowstring 13 and the plane parallel to the first plane and passing through the center of the axis 16 of rotation of the cam, changes its value from the chosen value of eccentricity down to zero.

Figure 6:
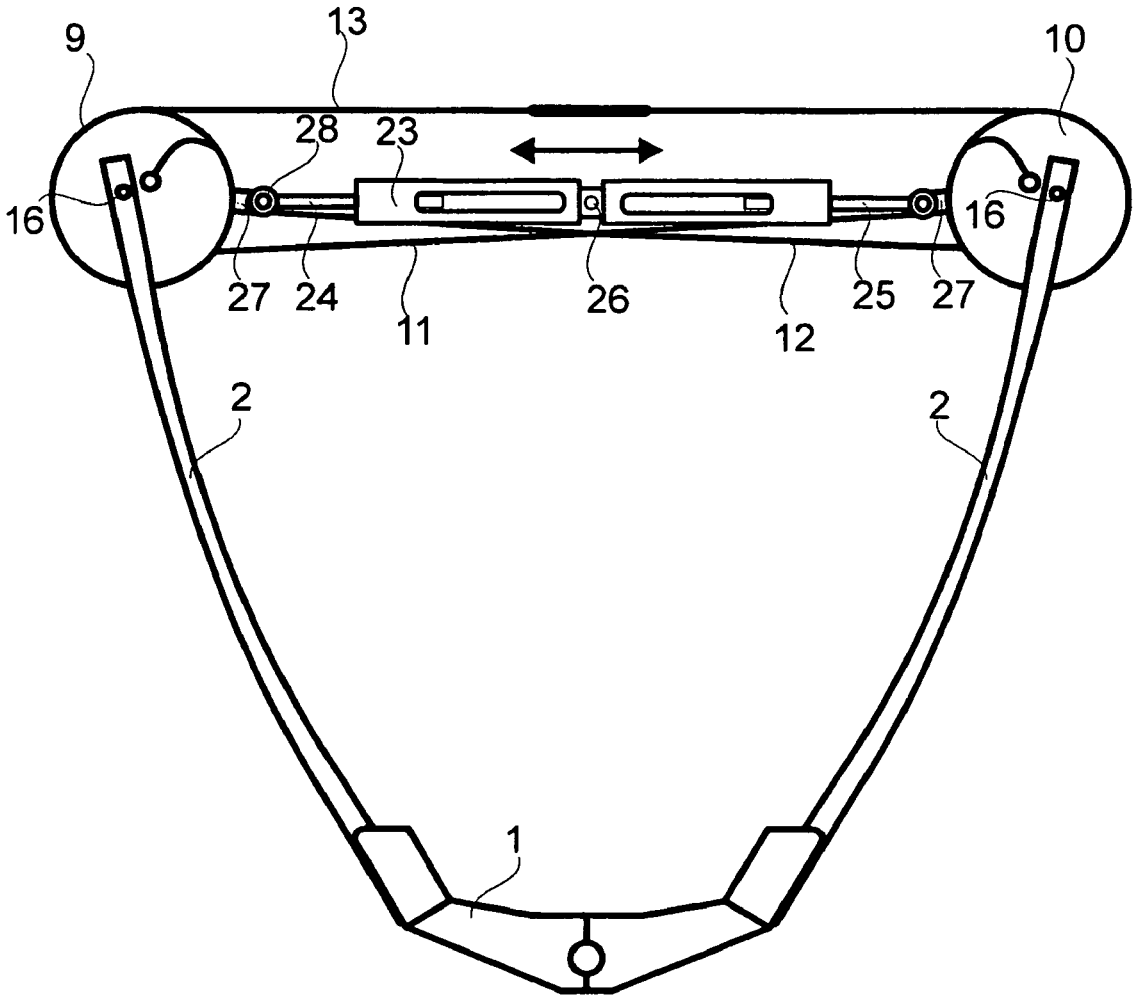
FIG. 6 illustrates the installation diagram of the detachable device.

This design of a crossbow (FIG. 6) uses the design of cables fastening, wherein the tackle bar 27 has one end attached to the axis 16 of rotation of cams 9, and the other end of the tackle bar 27, on the one side, is attached to cables 11, 12, and the on the other side a device for fastening the detachable device 23 is mounted. This decision allows to reduce the dimensions of the design as a whole and to use the detachable device 23 for mounting and removing the bowstring 13, cables 11, 12, that allows a shooter to replace the bowstring and cables of a crossbow in any conditions (when hunting, at a shooting-range, in field). This detachable device is designed for extending the limbs 2 or for bringing them together. The detachable device 23 consists of screw tension bars 24, 25 having a right and a left groove. The screw drafts 24, 25 are attached to tackle bars 27 and by rotating the cylinder 23 through an aperture 26 in one or other direction it is possible to bend and unbend the limbs 2 for mounting or removing the bowstring 13 and cables 11, 12. Use of such a detachable device 23 for the above purpose and the method for its fastening are new and are not found in the known art.

Figure 7:
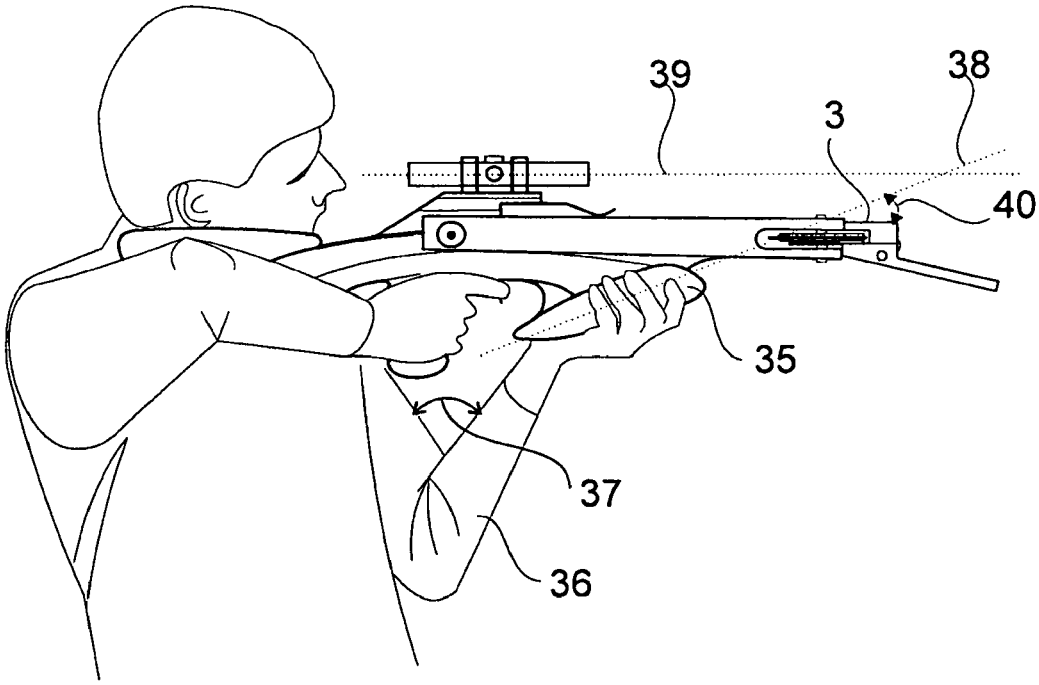
FIG. 7 illustrates the shape and inclination of the foregrip.

This design of a crossbow uses a foregrip 35 (FIG. 7) that is placed at an angle to the barrel 3 and, hence, at an angle to the line of aiming 39. The angle 40 between the axis of an inclination 38 of the foregrip 35 and the barrel of crossbow 3 has a preferable value ranging from 10 to 25 degrees, depending on the length of the crossbow barrel. This allows the shooter to choose the most convenient position depending on the length of shooter's hand 36 and the angle of grip 37 that makes handling of the crossbow and shooting easier and requiring less effort from the shooter. If the shooter has longer hands, then it is necessary to shift the palm of the supporting hand forward (away from itself) in the direction of the axis of inclination 38 of the foregrip 35, for getting the most convenient at the ready position. If the shooter has shorter hands, it is necessary to shift the palm of the supporting hand back (toward itself) in the direction of the axis of an inclination 38 of the foregrip 35, for getting the most convenient at the ready position.

The foregrip 35 has a conic shape with roundings on its ends and with a thickening in the area most close to the crossbow barrel 3. The thickening have such a size that shooter's fingers cannot fall into the working area of the bowstring thus providing the safety and convenience of holding the crossbow when shooting.

This design of a crossbow is to be used as follows. The bowstring 13 is to be pulled by applying force in the direction of the point of its fixing 41 to the trigger mechanism 4. Thus the loose parts of limbs 2 are bent in the direction of barrel 3, reserving the energy for shooting, the cams 9, 10 having two peripheral surfaces are rotating about the axis of rotation 16, thus unwinding the bowstring 13, at the same time the cables 11, 12 are spooling on cams 9, 10. After fixing the bowstring 13 on the trigger mechanism 4 the crossbow is ready for shooting.

The use of this crossbow design increase the maximum initial speed of the thrown body, increases the shooting accuracy and grouping of shots, reduces the crossbow dimensions, decreases kickback, noise and vibrations during shooting, simplifies crossbow assembling and disassembling, makes bowstring and cables replacement more comfortable and improves crossbow balancing and ergonomics.

The invention claimed is:

1. A reverse crossbow containing limbs, a limbs riser, the limbs being directed in the direction of shooting, identical cams having a mechanical center and located on ends of loose parts of said limbs, bowstring and cables passing through cams, a barrel where the said limbs riser is placed, a trigger mechanism and a foregrip, wherein the limbs riser is located on the edge of the barrel behind the trigger mechanism and is centered about the barrel using a cone on the bottom surface of the limbs riser, placed in a reciprocal conical recess in the barrel, where the said limbs riser is fixed to the barrel using a single threaded junction, wherein the initial angle of installation of limbs on their riser and the distance between the points of their fastening is chosen in such a manner that when raising the crossbow the axis of rotation of each cam crosses the line parallel to the central axis of the crossbow and passing through the point of the beginning of bend of each of the limbs, thus the distance between the axes of rotation of cams becomes less than the distance between the points of the beginning of bend of limbs, the axis of rotation of each cam is displaced about its mechanical center that is located inside the area formed by limbs, on a perpendicular to the point of mechanical center located on a straight line, connecting the mechanical center and the exit point of the bowstring, where the cam is placed with a possibility of rotation, where during such a rotation the said mechanical center does not cross the straight line parallel to the straight line connecting the mechanical center of the said cam and the exit point of the said bowstring, and passing through the axis of rotation of the said cam, and the said foregrip has a conic shape with roundings on its ends and it is placed at an angle of 10 to 25° to the said crossbow barrel, and the thickened part of the said foregrip is located in the area most close to the barrel.

* * * * *